US008833516B1

(12) United States Patent
Wurth et al.

(10) Patent No.: US 8,833,516 B1
(45) Date of Patent: Sep. 16, 2014

(54) ELEVATOR AND ESCALATOR TOOL

(71) Applicant: Wurtec Elevator Products & Services, Toldedo, OH (US)

(72) Inventors: Steven P. Wurth, Sylvania, OH (US); Terry Rodebaugh, Whitehouse, OH (US)

(73) Assignee: Wurtec Elevator Products & Services, Toledo, OH (US)

( * ) Notice: Subject to any disclaimer, the term of this patent is extended or adjusted under 35 U.S.C. 154(b) by 0 days.

(21) Appl. No.: 14/286,060

(22) Filed: May 23, 2014

Related U.S. Application Data

(63) Continuation of application No. 13/403,241, filed on Feb. 23, 2012, now Pat. No. 8,776,947.

(60) Provisional application No. 61/466,570, filed on Mar. 23, 2011.

(51) Int. Cl.

| | |
|---|---|
| ***E06C 1/38*** | (2006.01) |
| ***E06C 7/48*** | (2006.01) |
| ***E01D 1/00*** | (2006.01) |
| ***E06C 7/00*** | (2006.01) |
| ***E06C 7/08*** | (2006.01) |
| ***E06C 1/387*** | (2006.01) |
| ***E06C 7/18*** | (2006.01) |
| ***E06C 1/12*** | (2006.01) |

(52) U.S. Cl.

CPC ... *E06C 1/12* (2013.01); *E06C 7/00* (2013.01); *E06C 7/08* (2013.01); *E06C 1/387* (2013.01); *E06C 7/083* (2013.01); *E06C 7/183* (2013.01)

USPC ..... 182/1; 182/206; 14/69.5

(58) Field of Classification Search

USPC ..... 182/1, 206; 14/69.5

See application file for complete search history.

(56) References Cited

U.S. PATENT DOCUMENTS

| | | | |
|---|---|---|---|
| 2,476,401 | A | 7/1949 | Campion |
| 4,244,457 | A | 1/1981 | Ernst |
| 4,265,353 | A | 5/1981 | Hill |
| 4,276,956 | A | 7/1981 | Mamula et al. |
| 6,527,081 | B1 | 3/2003 | Tyner et al. |
| 7,219,766 | B2 | 5/2007 | Deuer |
| 7,857,115 | B2 | 12/2010 | LeBrecque et al. |
| 2009/0020360 | A1 | 1/2009 | May |
| 2011/0139544 | A1 | 6/2011 | Frick |

FOREIGN PATENT DOCUMENTS

| | | |
|---|---|---|
| JP | 07215647 | 8/1995 |
| JP | 08059159 | 3/1996 |

*Primary Examiner* — Alvin Chin-Shue

(74) *Attorney, Agent, or Firm* — Fraser Clemens Martin & Miller LLC; Charles F. Charpie

(57) ABSTRACT

A tool for use with elevators and escalators, having two or more slidably connected assemblies, is provided. The assemblies have rails connected together and arranged in a parallel orientation. Support members are connected to the rails and a plurality of treads is attached to the support members. The treads are configured to provide a working surface upon which personnel can stand, sit or kneel and upon which materials can be placed. An extension member is connected to one end of the rails. Each extension member includes a locking member and a stop. Each locking member includes a first arm, a second arm and a third arm. In an open position, the third arm is in contact with the stop and in a closed position, the second arm is in contact with the stop. The assemblies are configured to bridge gaps formed within and around the elevators and escalators.

20 Claims, 15 Drawing Sheets

ELEVATOR AND ESCALATOR TOOL

RELATED APPLICATIONS

This application is a Continuation Utility Patent Application and claims the benefit of pending U.S. Utility application Ser. No. 13/403,241, filed Feb. 23, 2012, and U.S. Provisional Application No. 61/466,570, filed Mar. 23, 2011, the disclosures of which are incorporated herein by reference in their entirety.

BACKGROUND OF THE INVENTION

This invention relates in general to the construction and maintenance of vertical transportation equipment. More specifically, this invention relates to tools that can be used for construction and maintenance of elevators and escalators.

Structures, such as commercial buildings, can use a variety of vertical transportation devices, including elevators and escalators, to transport people and materials from one building floor to another. In certain instances, the construction of the elevators and escalators requires the bridging of gaps formed in building spaces in and around the elevators and escalators. In other instances, maintenance activities of elevators and escalators can require the removal of certain components or assemblies, thereby forming gaps within the elevators and escalators or in the building spaces in and around the elevators and escalators.

It would be advantageous to provide tools configured to bridge gaps formed during the construction and maintenance of elevators and escalators.

SUMMARY OF THE INVENTION

The above objects, as well as other objects not specifically enumerated, are achieved by a tool for use in the construction and maintenance of elevators and escalators. The tool includes two or more assemblies connected together in a slidable arrangement. Each of the assemblies has a plurality of rails connected together and arranged in a generally parallel orientation. A plurality of support members is connected to the plurality of rails and a plurality of treads is attached to the plurality of support members. The plurality of treads is configured to provide a working surface upon which construction or maintenance personnel can stand, sit or kneel. The plurality of treads is further configured to provide a working surface upon which materials can be placed. An extension member is connected to one end of each of the rails. Each extension member includes a locking member and a stop. Each locking member includes a first arm, a second arm extending from the first arm and a third arm extending from the second arm. In an open position, the third arm of the locking member is in contact with the stop and in a closed position, the second arm is in contact with the stop. The two or more assemblies are configured to bridge gaps formed within the elevators and escalators and bridge gaps formed in building spaces in and around the elevators and escalators.

Various objects and advantages of the elevator and escalator tool will become apparent to those skilled in the art from the following detailed description of the preferred embodiment, when read in light of the accompanying drawings

DETAILED DESCRIPTION OF THE INVENTION

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

The description and figures disclose an elevator and escalator tool (hereafter "tool") for use in the construction and maintenance of elevators and escalators. Generally, the tool is configured to bridge gaps formed within the elevators and escalators and gaps formed in building spaces in and around the elevators and escalators. The term "elevator", as used herein, is defined to mean any device configured for hoisting materials or people from one level to another level. The term "escalator", as used herein, is defined to mean any device having a power-driven set of stairs arranged in an endless belt that ascend or descent in a continuous loop. The term "gap", as used herein, is defined to mean any separation in space between structures or components. The term "materials", as used herein, is defined to mean any parts, components, assemblies, tools or miscellaneous supplies that might be used in the construction or maintenance of the elevator or escalator.

Figure 1:
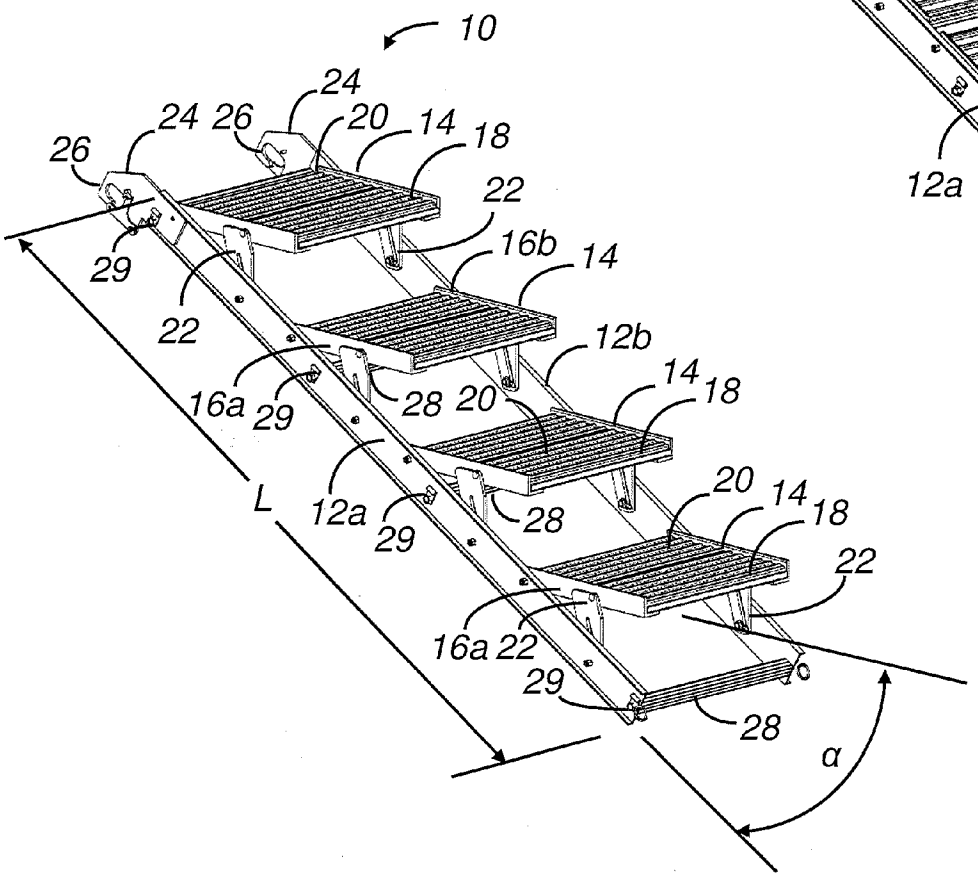
FIG. 1 is a perspective view of a first embodiment of an elevator and escalator tool.

Referring now to the drawings, there is illustrated in FIG. 1 a first embodiment of an elevator and escalator tool, indicated generally at 10. The tool 10 includes opposing rails 12*a* and 12*b* and a plurality of support assemblies 14 connected to the rails 12*a* and 12*b*.

In the embodiment illustrated in FIG. 1, the rails 12*a* and 12*b* have a "channel" or "u" shaped cross-sectional shape and are formed from a metallic material, such as the non-limiting example of aluminum. However, in other embodiments, the rails 12*a* and 12*b* can have other desired cross-sectional shapes and can be formed from other materials, such as for example, steel or reinforced polymeric materials.

Referring again to FIG. 1, the rails 12*a* and 12*b* have a length L sufficient for a desired quantity of support assemblies 14. In the illustrated embodiment, the length L is in a range of from about 50.0 inches to about 70.0 inches, sufficient for a quantity of four support assemblies 14. In other embodiments, the length L can be less than about 50.0 inches or more than about 70.0 inches, sufficient for more or less than four support assemblies 14.

Figure 2:
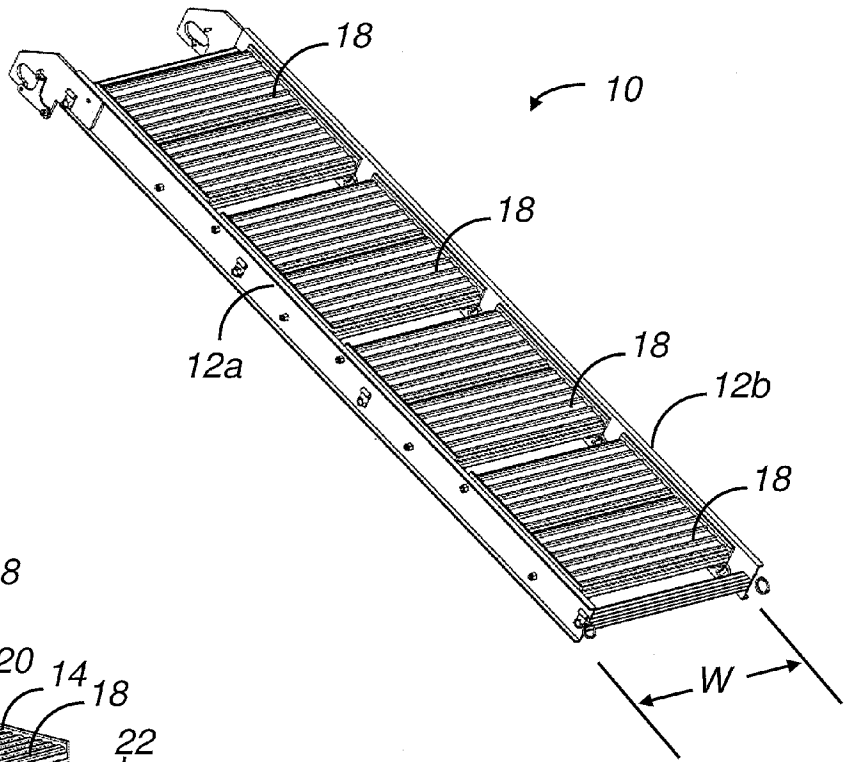
FIG. 2 is a perspective view of the elevator and escalator tool of FIG. 1 illustrating the plurality of treads in a closed position.

Referring now to FIG. 2, the tool 10 has a width W in a range of from about 10.0 inches to about 30.0 inches. In other embodiments, the width W can be less than about 10.0 inches or more than about 30.0 inches.

Referring again to FIG. 1, each of the support assemblies 14 includes opposing support members 16*a* and 16*b*. The support members 16*a* and 16*b* are configured to provide a supporting base for the removably attached treads 18. In the illustrated embodiment, the support members 16*a* and 16*b* have an "L" shaped cross-sectional shape and are formed from a metallic material, such as the non-limiting example of aluminum. In other embodiments, the support members 16*a* and 16*b* can have other cross-sectional shapes and can be formed from other materials, such as for example, steel or reinforced polymeric materials.

The treads 18 are configured to provide a working surface upon which construction or maintenance personnel can stand, sit or kneel. The treads 18 are also configured as a surface upon which materials can be placed. Each tread 18 has an upper surface 20. In certain embodiments, the upper surface 20 has a tread pattern. The term "tread pattern", as used herein, is defined to mean any combination of projections and/or imprints. While the embodiment shown in FIG. 1 illustrates a tread pattern having parallel projections, it should be appreciated that in other embodiments, the tread pattern can be any desired design. In still other embodiments, the upper surface 20 can have other configurations, including the non-limiting examples of a smooth surface or an anti-slip surface.

Referring again to FIG. 1, the support members 16*a* and 16*b*, are connected to the rails 12*a* and 12*b* in part by brackets 22. The brackets 22 are configured to allow the support members 16*a* and 16*b* and their associated treads 18 to rotate from an extended position as shown in FIG. 1 to a closed position as shown in FIG. 2. In certain embodiments, the brackets 22 can be linked together by a linkage (not shown) such that rotation of a single tread 18 from a closed position to an extended position results in the rotation of more than one tread 18 from a closed position to an extended position. The linkage can have any desired configuration. The brackets 22 will be discussed in more detail below. In other embodiments, the brackets 22 can be configured to fixed the support members 16*a* and 16*b*, in a permanent position relative to the rails 12*a* and 12*b*, thereby preventing rotation of the treads 18.

Referring again to FIG. 1, in an extended position the treads 18 form an angle $\alpha$ relative to the rails 12*a* and 12*b*. In the illustrated embodiment, the angle $\alpha$ is in a range of from about 20° to about 40°. In other embodiments, the angle $\alpha$ can be less than about 20° or more than about 40°. While the embodiment illustrated in FIG. 1 illustrates each of the treads 18 as having the same angle $\alpha$, it should be appreciated that in other embodiments, the tool 10 can be configured such that each of the treads 18 can have a different angle $\alpha$.

The tool 10 further includes opposing extension members 24. Each extension member 24 is connected to one end of the rails 12*a* and 12*b*. Each extension member 24 includes a retention segment 26. As will be explained in more detail below, the retention segments 26 have a cross-sectional shape sufficient to engage an attachment point within the elevator, escalator or building structure. In the illustrated embodiment, the retention segments 26 have an arcuate cross-sectional shape sufficient to engage an escalator axle having a circular cross-sectional shape. However, it should be appreciated that the retention segments 26 can have other cross-sectional shapes.

Referring again to FIG. 1, the tool 10 further includes a plurality of spaced apart cross member 28. The cross members 28 are configured to connect the rails 12*a* and 12*b* to each other along the length L of the tool 10, thereby providing structural support to the tool 10. In the illustrated embodiment, the cross members 28 are connected to the rails 12*a* and 12*b* by fastening hardware, such as for example, through bolts and nuts. Alternatively, the cross members 28 can be connected to the rails 12*a* and 12*b* by other fastening mechanisms or devices including the non-limiting examples of clips or clamps.

Figure 3A:
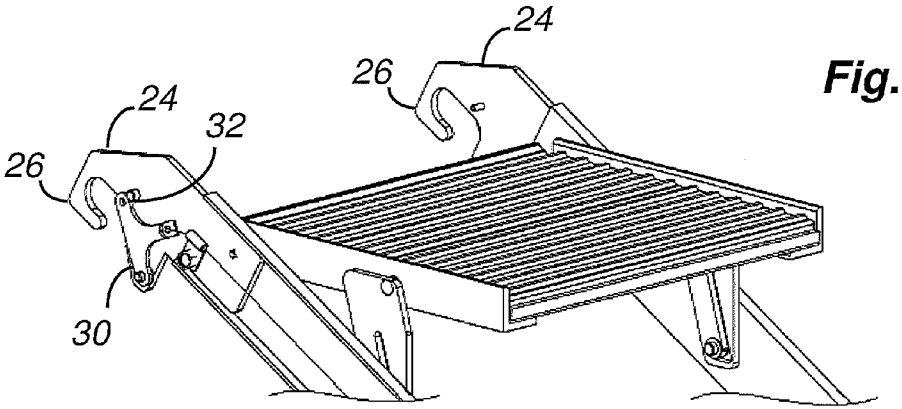
FIG. 3*a* is a perspective view of a portion of the elevator and escalator tool of FIG. 1 illustrating an extension member and retention segment.
Figure 3B:
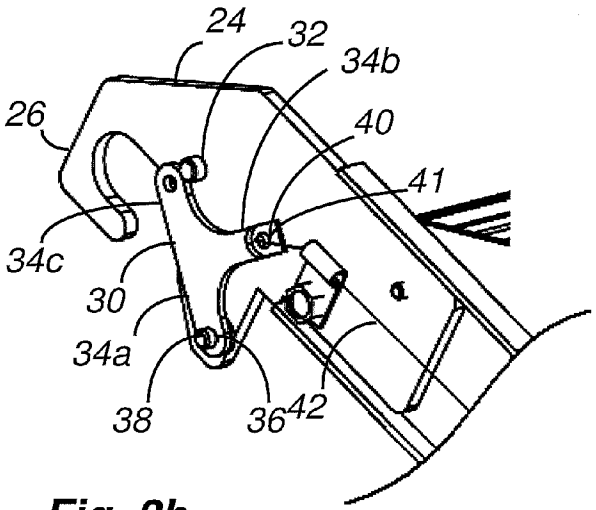
FIG. 3*b* is an expanded perspective view of the extension member of FIG. 1 illustrating the retention segment in an open position.
Figure 3C:
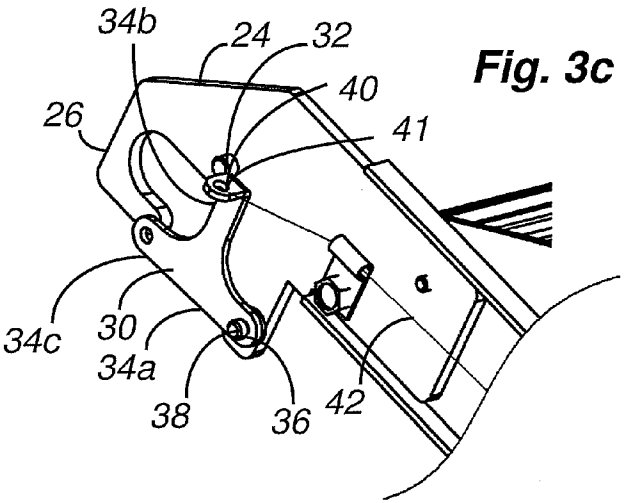
FIG. 3*c* is an expanded perspective view of the extension member of FIG. 1 illustrating the retention segment in a closed position.

Referring now to FIGS. 3*a*-3*c*, the extension members 24 are illustrated. Each extension member 24 includes the retention segment 26, a rotatably mounted locking member 30 and a stop 32. As discussed above, the retention segment 26 has an arcuate cross-sectional shape sufficient to engage an escalator axle having a circular cross-sectional shape. Referring now to FIGS. 3*b* and 3*c*, the locking segment 30 has a first arm 34*a*, a second arm 34*b* and a third arm 34*c*. The first arm 34*a* includes an aperture 36. The first arm 34*a* of the locking member 30 is attached to the extension member 24 by fastening hardware 38 such that the locking member 30 can rotate about the fastening hardware 38. In the illustrated embodiment, the fastening hardware 38 is a threaded fastener and a nut. However, in other embodiments, the fastening hardware 38 can be other desired mechanisms and devices.

The second arm 34*b* extends from the first arm 34*a*. In the illustrated embodiment, the second arm 34*b* extends in a generally perpendicular direction from the first arm 34*a*. Alternatively, the second arm 34*b* can extend from the first arm 34*a* in any desired direction. The second arm 34*b* includes a tab 40. The tab 40 includes an aperture 41. The aperture 41 is configured for attachment to a release line 42. The release line 42 will be discussed in more detail below.

The third arm 34*c* extends from the first and second arms 34*a* and 34*b*. In the illustrated embodiment, the third arm 34*c* extends in a generally perpendicular direction from the second arm 34*b*. Alternatively, the third arm 34*c* can extend from the second arm 34*b* in any desired direction.

Referring again to FIGS. 3*b* and 3*c*, the locking member 30 is configured for rotation about the fastening hardware 38 from an open position (as shown in FIG. 3*b*) to a closed position (as shown in FIG. 3*c*). The locking member 30 is urged by the release line 42 and rotates into the open position until the third arm 34*c* contacts the stop 32. When a step axle (not shown) is seated within the retention segment 26 and the release line 42 is relaxed, the force of gravity urges the locking member 30 into the closed position until the second arm 34*b* contacts the stop 32. In the closed position, the locking member 30 retains the step axle in an engaged position within the retention segment 26. Optionally, the locking member 30 can be biased in either the open or closed position by a biasing mechanism (not shown), such as for example, a spring. The retention segment 26 and the locking member 30 will be discussed in more detail below.

Figure 3D:
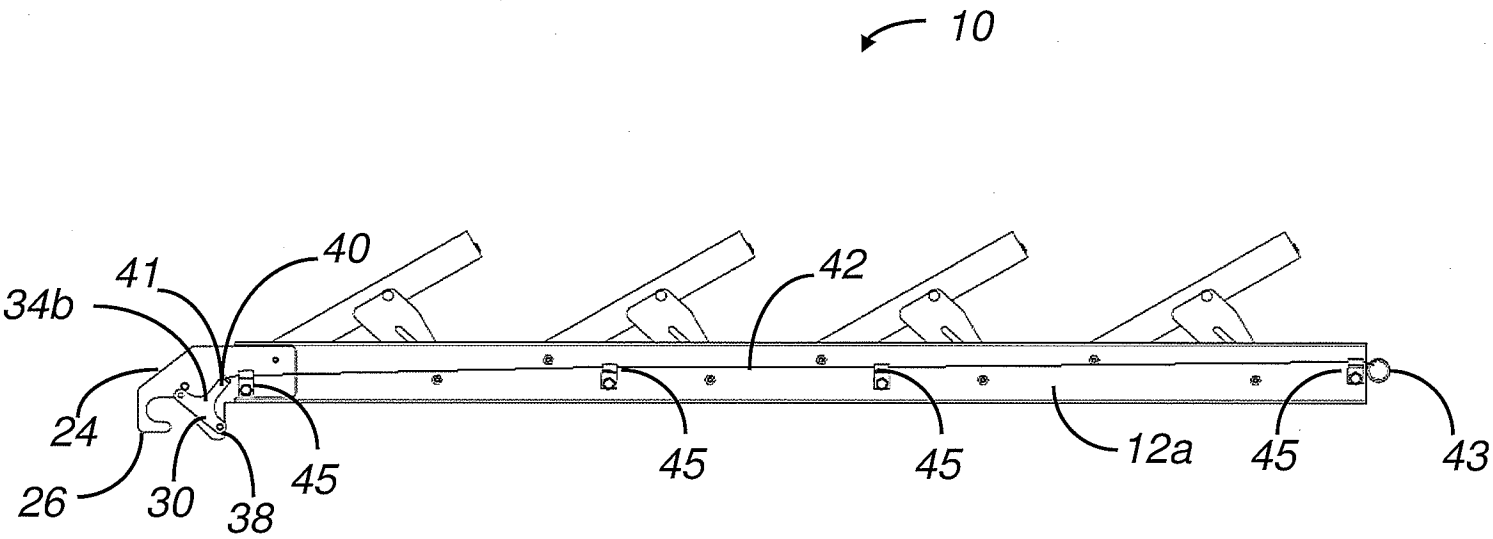
FIG. 3*d* is side view, in elevation, of the elevator and escalator tool of FIG. 1 illustrating the release line.

Referring now to FIGS. 3*c* and 3*d*, the tool 10 is illustrated with the rails 12*a* and 12*b*, extension members 24 and retention segments 26. The locking member 30 is attached to the extension member 24 by the fastening hardware 38. One end of the release line 42 is connected to the aperture 41 in the tab 40 of the second arm 34*b* of the locking mechanism 30. The other end of the release line 42 is connected to a ring 43 positioned at the end of the tool 10 opposite the extension member 24. The ring 43 is configured as a handle for urging the locking member 30 into the open position. Between the tab 40 and the ring 43, the release line 42 passes through a plurality of clips 45. The clips 45 are configured to retain the release line 42 is a convenient position against the rails 12*a* and 12*b*. In operation, the locking member 30 is urged by pulling on the release line 42 or by pulling on the ring 43 such that the locking member 30 rotates into the open position until the third arm 34*c* contacts the stop 32.

Figure 4:
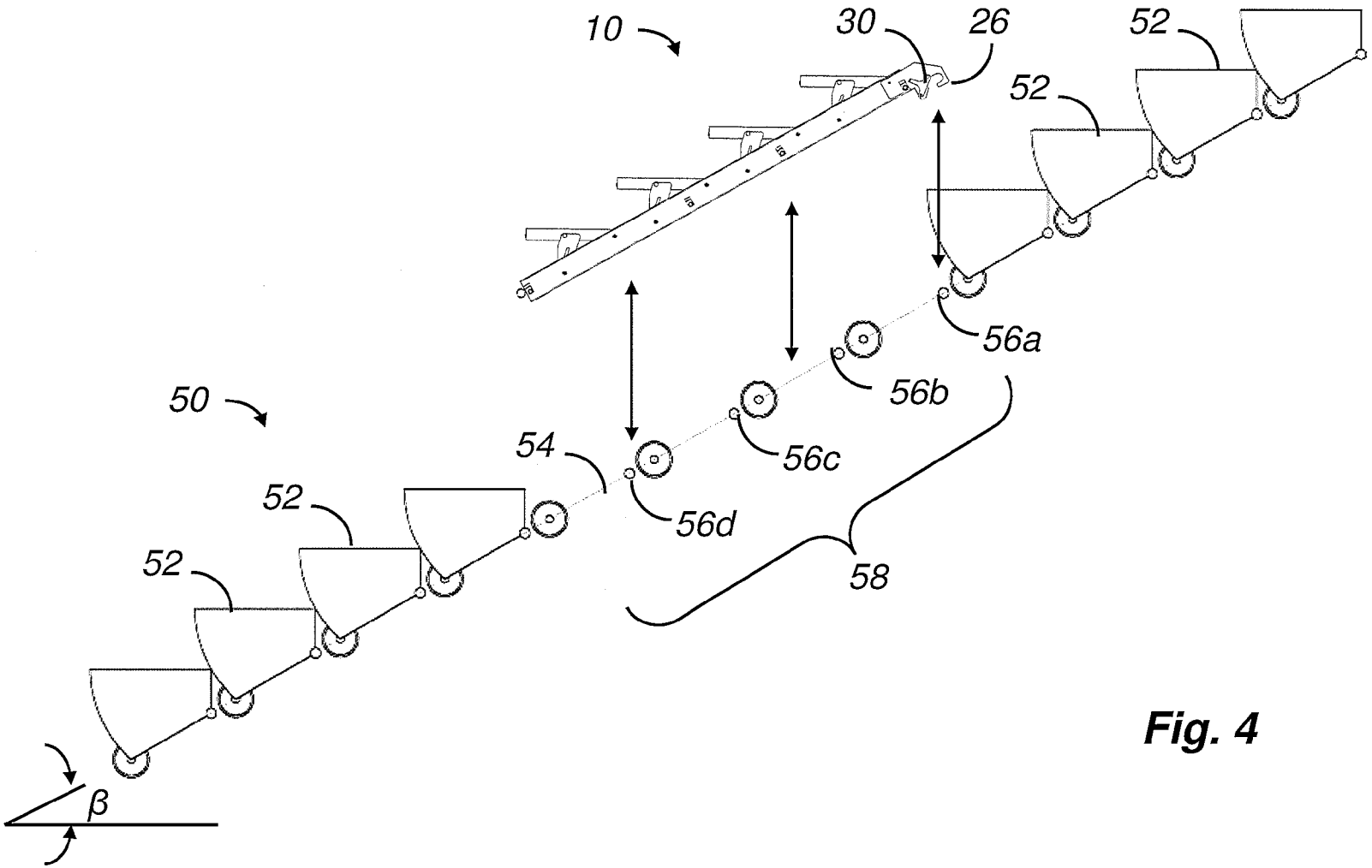
FIG. 4 is a side view, in elevation, of the elevator and escalator tool of FIG. 1 configured for installation in an escalator having several steps removed.

Referring now to FIG. 4, a first application of the tool 10 is illustrated. An incline portion of a traditional escalator 50 is illustrated. The escalator 50 includes a plurality of steps 52 connected to opposing step chains 54 (for purposes of clarity, only one step chain 54 is illustrated). The opposing step chains 54 are connected to each other by a plurality of spaced apart step axles 56*a*-56*d*. The steps 52, step chains 54 and step axles 56*a*-56*d* are conventional in the art. The incline portion of the escalator 50 forms an incline angle β with a substantially horizontal line. In the illustrated embodiment, the angle β is about 30°. In other embodiments, the angle β can be more or less than 30°. A gap 58 in the steps 52 can be formed by removing a series of steps 52 during the construction or maintenance of the escalator 50. While the embodiment illustrated in FIG. 4 shows a gap 58 formed by the removal of a quantity of four steps 52, it should be appreciated that in other embodiments, a quantity of more or less than fours steps 52 can form the gap 58.

Referring again to FIG. 4, the tool 10 is configured to cooperate with the step axles 56*a*-56*d* in such a manner so as to bridge the gap 58 formed by the removal of the steps 52. In a first installation step, the locking member 30 is urged into the open position by pulling on the release line 42. Once the locking member 30 is in the open position, the retention segment 26 of the extension member 24 is configured to engage and hook the step axle 56*a*. Once the step axle 56*a* is seated within the retention segment 26, the release line 42 securing the locking member 30 is relaxed and the locking member 30 rotates into the closed position. Once the locking member 30 is in the closed position, the tool 10 is secured to the step axle 56*a*. Finally, once the tool 10 is secured to the step axle 56*a*, the tool 10 is rotated such that the rails 12*a* and 12*b* seat on an upper surface of the step axles 56*b*-56*d*.

Figure 5:
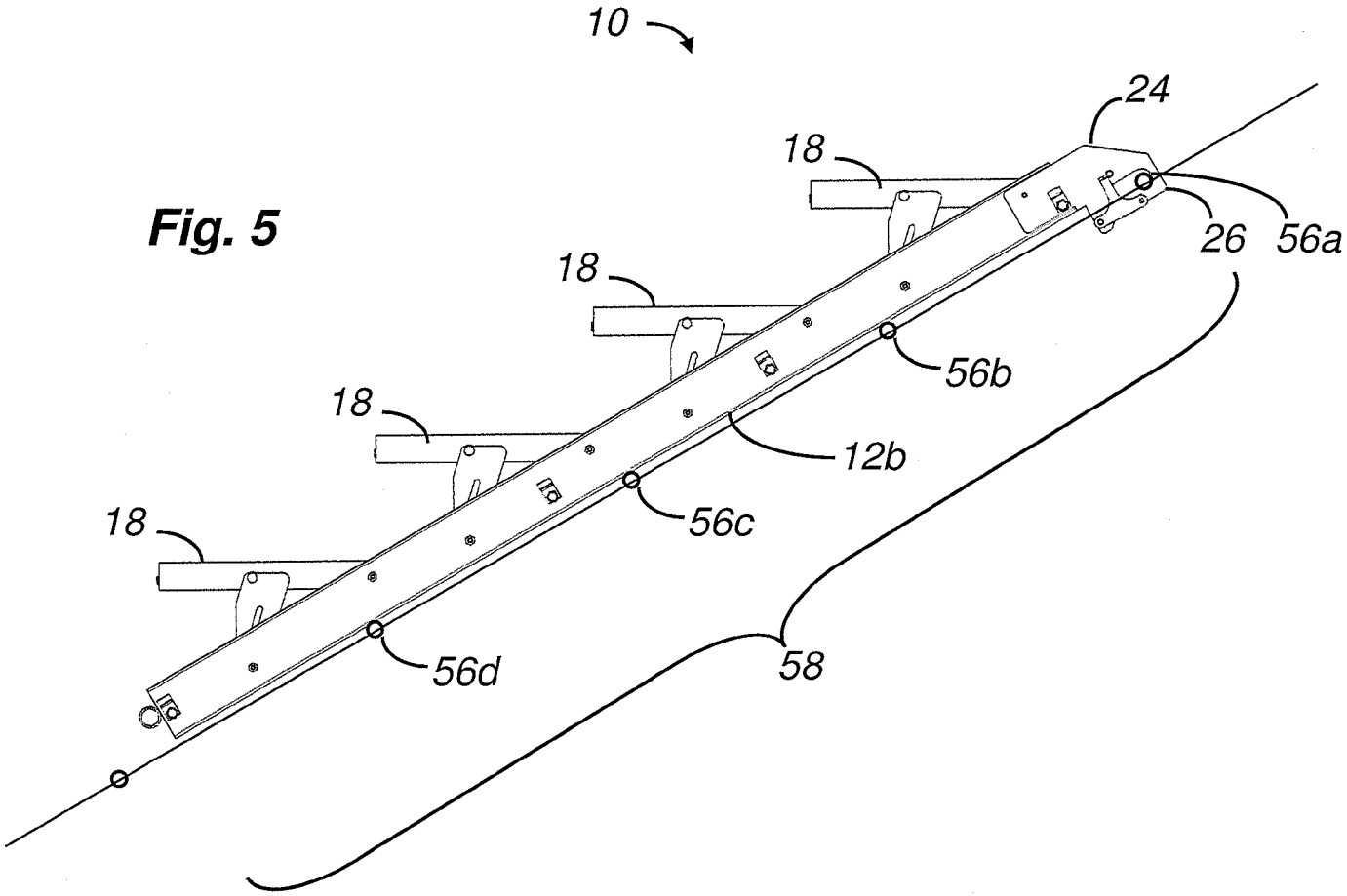
FIG. 5 is a side view, in elevation, of a portion of the escalator of FIG. 4 illustrating the installed elevator and escalator tool.

Referring now to FIG. 5, the tool 10 is illustrated in an installed position with the retention segment 26 of the extension member 24 engaged with the step axle 56*a* and the rails 12*a* and 12*b* seated on the upper surfaces of the step axles 56*b*-56*d*. In this position, the tool 10 bridges the gap 58 formed by the removed steps (not shown). The treads 18 can be rotated from a closed position (not shown) to the extended position such as to provide working surfaces. As will be discussed in more detail below, the treads 18 can be rotated to various extended positions, such that one of the extended positions is a substantially horizontal working surface.

The tool 10 advantageously provides several benefits, although all of the benefits may not be present in all embodiments and uses of the tool 10. First, as shown in FIG. 5, the tool 10 can be supplied in any length L such as to accommodate any distance between adjacent step axles 56*a*-56*d*. Accordingly, the tool 10 is not sized or limited by specific distances between adjacent steps axles 56*a*-56*d*. Second, the tool 10 can accommodate any incline angle β. Third, with the treads 18 arranged in a closed position, the tool 10 can accommodate a substantially horizontal gap that can occur in the upper and lower portions of the escalator where the steps are moving in substantially horizontal plane. Fourth, the tool 10 can be sized to accommodate the distance of any desired number of removed steps. Fifth, the width W of the tool 10 can be sized to accommodate the width of any step axle. Sixth, since the embodiment of the tool 10 illustrated in FIG. 1 bridges at least two step axles and often more than two step axles, the tool 10 provides a stable working platform that is highly resistant to tipping.

While the embodiment of the tool 10 illustrated in FIG. 1 is configured to bridge at least two step axles as shown in FIG.

4, it should be understood that in other embodiments, the tool 10 can be configured such that the retention segment 26 of the extension member 24 engages a step axle and the rails 12*a* and 12*b* engage other components of the escalator. Accordingly, in this alternate embodiment, the tool 10 can be configured such that the tool 10 may span gaps having a distance of less than the distance between two adjacent step axles.

Figure 6:
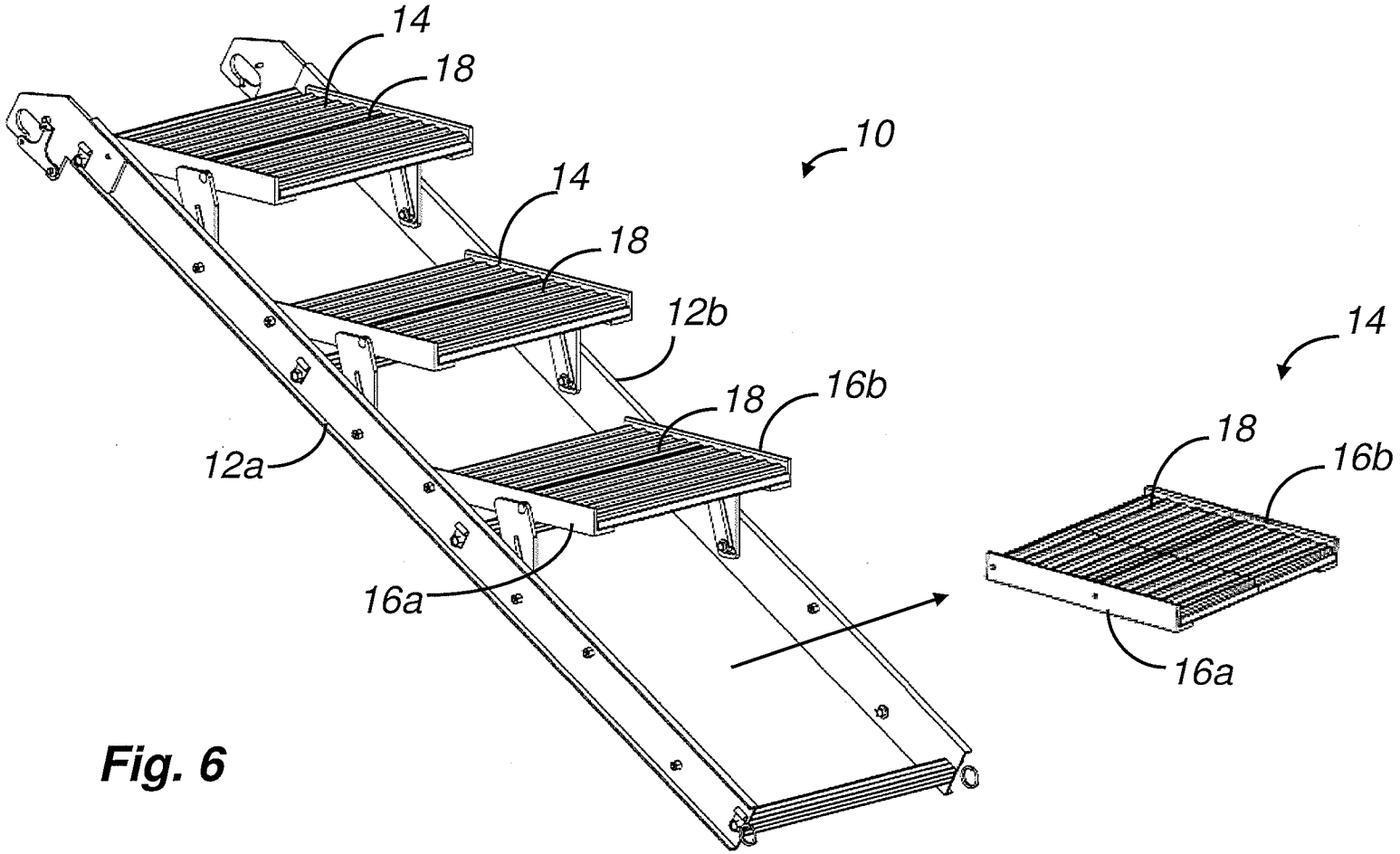
FIG. 6 is a perspective view of the elevator and escalator tool of FIG. 1 illustrating removable support members and treads.

Referring now to FIG. 6, optionally the tool 10 can be configured such that any quantity of support assemblies 14 can be easily removed from the tool 10, where each support assembly 14 includes the treads 18 and the support members 16*a* and 16*b*. Removal of one or more support assemblies 14 can advantageously provide access to other areas of the escalator (not shown). In the illustrated embodiment, the support assemblies 14 are assembled to the rails 12*a* and 12*b* using mechanical fasteners, such as for example, nuts and bolts (not shown). However, it should be understood that in other embodiments, the support assemblies 14 can be assembled using other components or methods, including the non-limiting examples of clips and clamps. While the embodiment illustrated in FIG. 6 shows a single support assembly 14 as being removed from the tool 10, in other embodiments any desired number of support assemblies 14 can be removed from the tool 10.

Figure 7B:
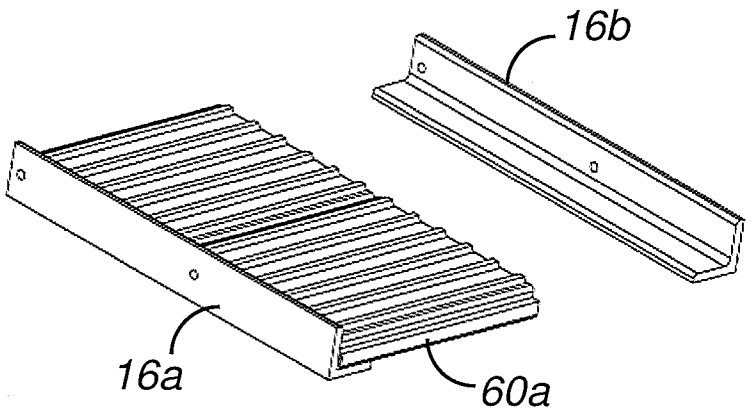
FIG. 7*b* is a perspective view of the removed tread of FIG. 7*a* illustrating a removable tread element.
Figure 7A:
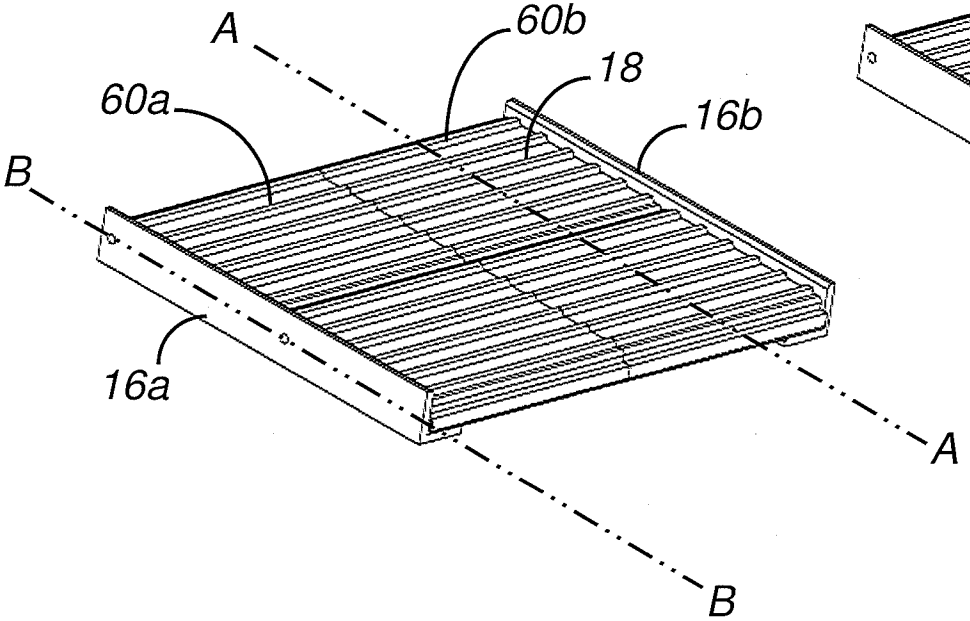
FIG. 7*a* is a perspective view of the removed support members and treads of FIG. 6.

Referring now to FIG. 7*a*, a tread 18 is shown with its associated support members 16*a* and 16*b*. Optionally, the tread 18 can be formed from one or more tread elements. In the illustrated embodiment, the tread 18 is formed from a quantity of two cooperating tread elements 60*a* and 60*b*. In other embodiments, the tread 18 can be formed from any desired quantity of cooperating tread elements. In the illustrated embodiment, the tread elements 60*a* and 60*b*, are arranged such that a major axis A-A of the tread elements 60*a* and 60*b*, is substantially parallel to a longitudinal axis B-B of the support members 16*a* and 16*b*. Alternatively, as will be discussed in more detail below, the tread elements 60*a* and 60*b* can be arranged in other configurations relative to the longitudinal axis B-B of the support members 16*a* and 16*b*.

Referring now to FIG. 7*b*, optionally one or both of the tread elements 60*a* and 60*b* can be easily removed from the support members 16*a* and 16*b*. Removal of one or more of the tread elements 60*a* and 60*b* can advantageously provide access to other areas of the escalator (not shown). While the embodiment illustrated in FIG. 7*b* shows the tread element 60*b* as being removed, it should be appreciated that in other embodiments, both tread elements 60*a* and 60*b* can be removed.

As discussed above, the tread elements, coupled with the associated support members to form the tread, can be arranged in other configurations. Referring now to FIG. 8*a*, another embodiment of the treads is illustrated. In this embodiment, tread elements 160*a* and 160*b* are arranged such that a major axis C-C of the tread elements 160*a* and 160*b* is substantially perpendicular to the longitudinal axis B-B of the support members 116*a* and 116*b*.

Figure 8B:
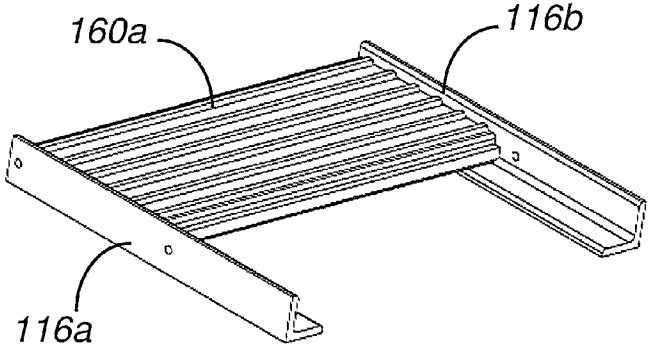
FIG. 8*b* is a perspective view of the removable support members and treads of FIG. 8*a* illustrating a removable tread element.
Figure 8A:
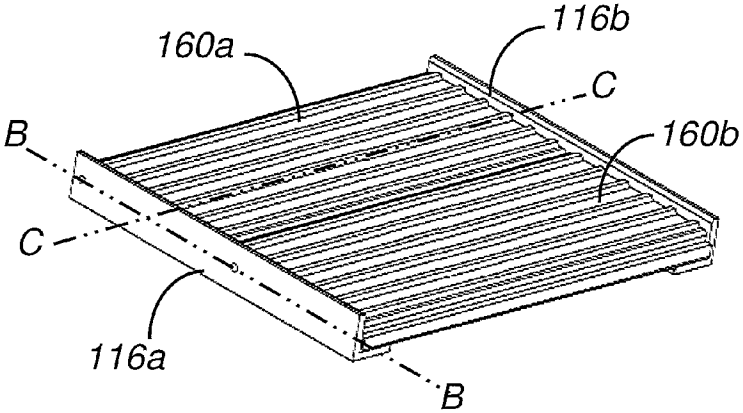
FIG. 8*a* is a perspective view of a second embodiment of removable support members and treads of the elevator and escalator tool of FIG. 1.

Referring now to FIG. 8*b*, optionally one or both of the tread elements 160*a* and 160*b* can be easily removed from the support members 116*a* and 116*b*. Removal of one or more of the tread elements 160*a* and 160*b* can advantageously provide access to other areas of the escalator (not shown). While the embodiment illustrated in FIG. 8*b* shows tread element 160*b* as being removed, it should be appreciated that in other embodiments, both tread elements 160*a* and 160*b* can be removed.

Figure 8C:
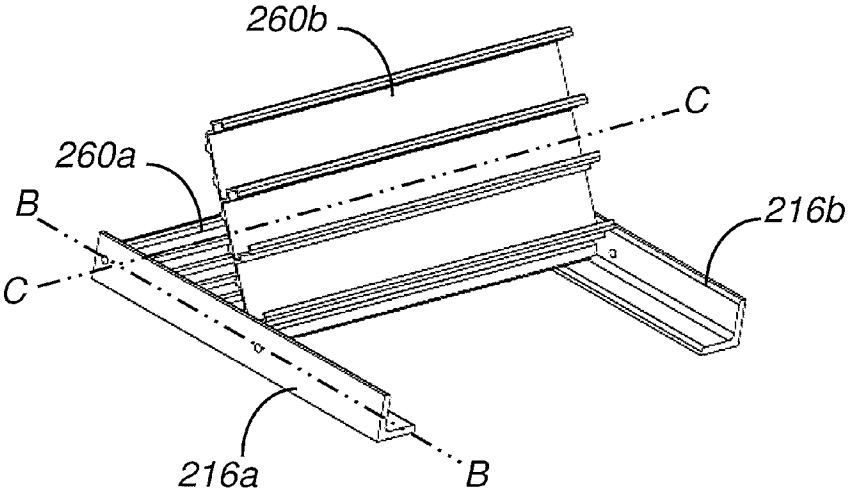
FIG. 8*c* is a perspective view of the removable support members and treads of FIG. 8*a* illustrating a rotatable tread element.

In another embodiment as illustrated in FIG. 8*c*, tread elements 260*a* and 260*b* are again arranged such that a major axis C-C of the tread elements 260*a* and 260*b* is substantially perpendicular to a longitudinal axis B-B of the support members 216*a* and 216*b*. However, in this embodiment, the tread elements 260*a* and 260*b* are pivotally attached to the support members 216*a* and 216*b*, thereby allowing either tread element 260*a* or 260*b* to be rotated to a substantially vertical position. The rotation of the tread element 260*b* to the substantially vertical position allows access to other areas of the escalator (not shown).

Figure 9:
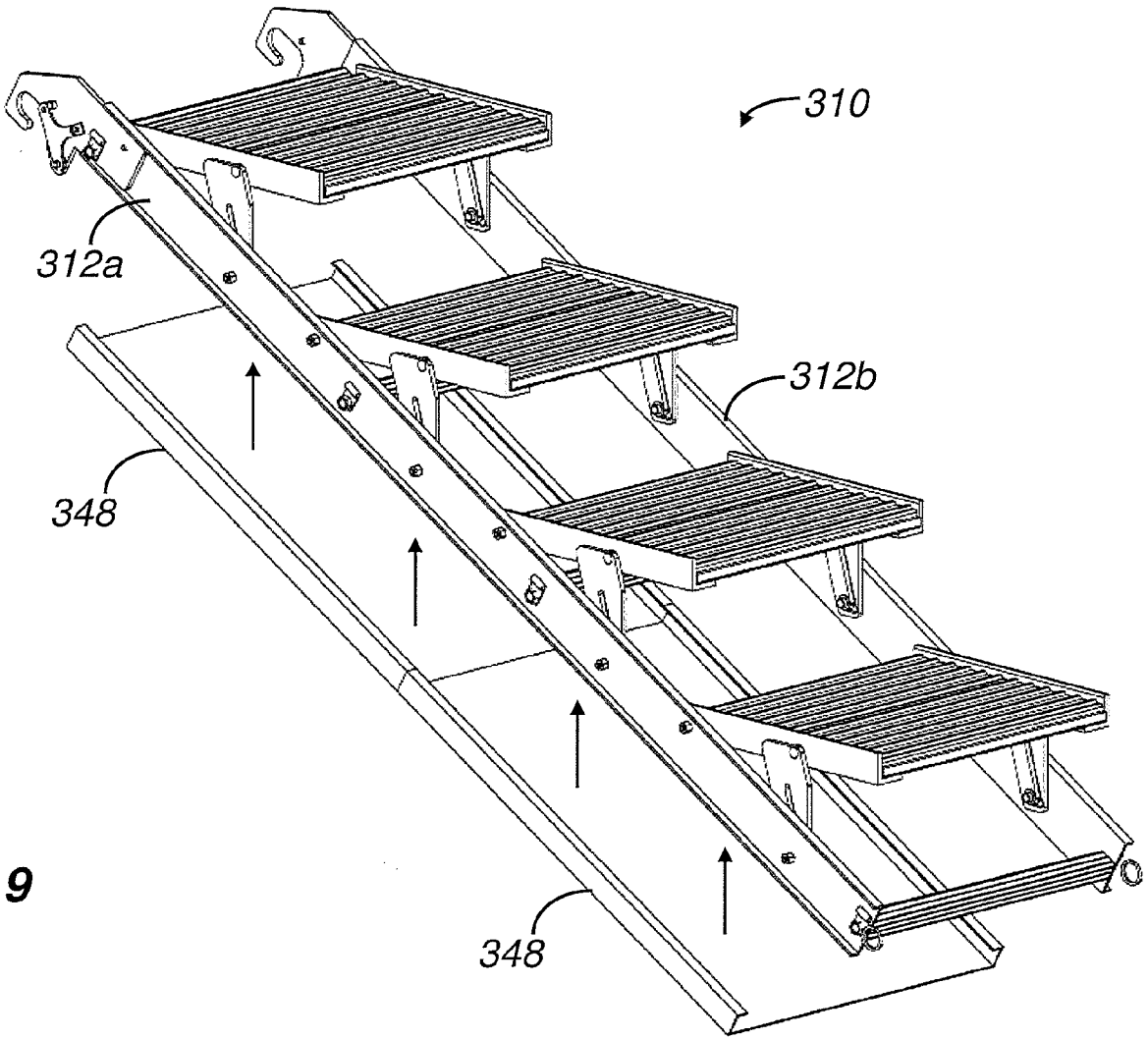
FIG. 9 is a perspective view of another embodiment of the elevator and escalator tool of FIG. 1 illustrating a plurality of pan elements attached to rails.

Referring now to FIG. 9, another embodiment of a tool is shown generally at 310. In this embodiment, the tool 310 is the same as, or similar to, the tool 10 illustrated in FIG. 1 and discussed above with the exception that a plurality of pan elements 348 are attached to rails 312*a* and 312*b*. The pan elements 348 are configured to catch construction materials falling through the tool 310 and prevent the construction materials from falling into other areas of the escalator. In the illustrated embodiment, a quantity of two pan elements 348 are shown positioned end-to-end. The pan elements 348 taken together extend substantially the length of the tool 310. Alternatively, a single pan element 348 or more than two pan elements 348 can be used and the pan elements can extend to any desired distance less than the length of the tool 310. In the illustrated embodiment, the pan elements 348 are attached to the rails 312*a* and 312*b* with fasteners (not shown). However, in other embodiments, the pan elements 348 can be attached to the rails 312*a* and 312*b* with other structures, mechanisms or devices including the non-limiting examples of clips or clamps.

In the illustrated embodiment, the pan elements 348 are formed from a rigid material, such as the non-limiting examples of sheet metal or reinforced polymeric materials. In other embodiments, the pan elements 348 can be formed from flexible materials, such as for example fabric or drop cloths. In still other embodiments, the pan elements 348 can be foraminous materials or netting.

Figure 10:
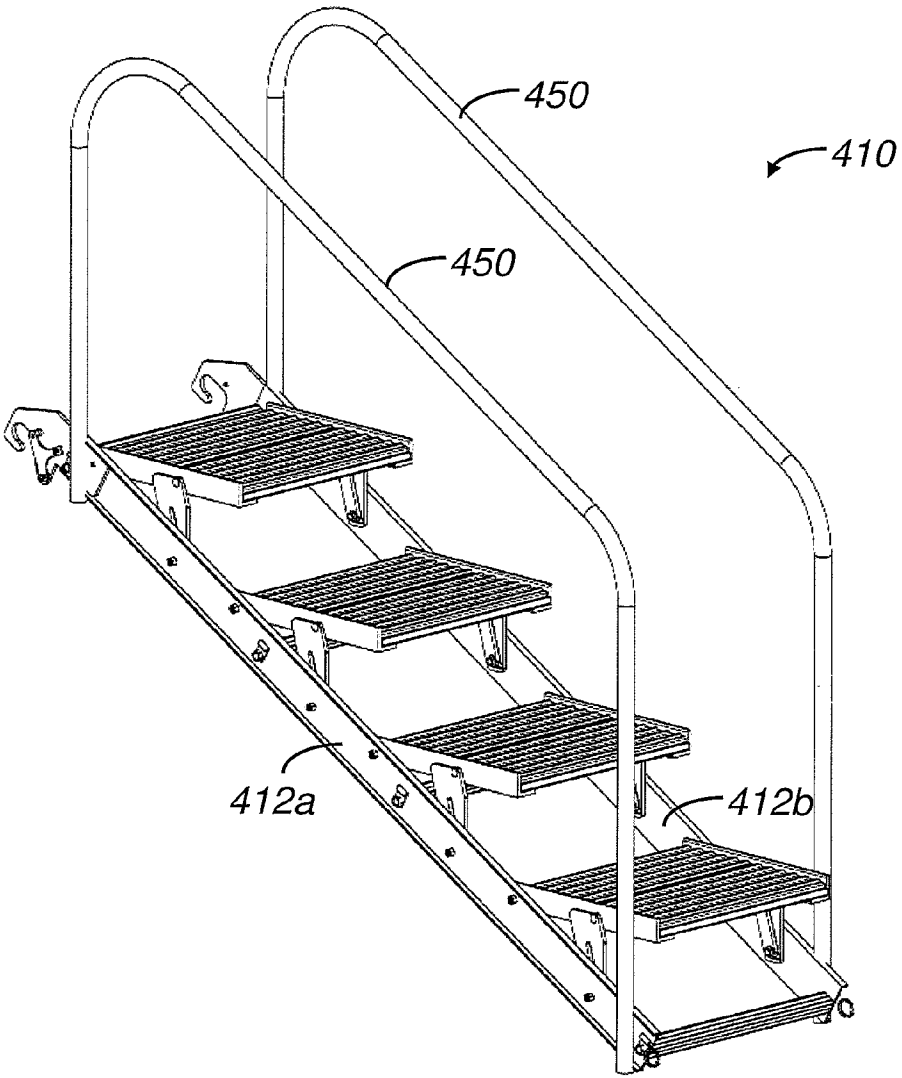
FIG. 10 is a perspective view of another embodiment of the elevator and escalator tool of FIG. 1 illustrating a plurality of handrails attached to rails.

Referring now to FIG. 10, another embodiment of a tool is shown generally at 410. In this embodiment, the tool 410 is the same as, or similar to, the tool 10 illustrated in FIG. 1 and discussed above with the exception that a plurality of handrails 450 are attached to the rails 412*a* and 412*b*. The handrails 450 are configured for the safety of personnel positioned on the tool 410. While the embodiment illustrated in FIG. 10 shows a quantity of two handrails 450, it should be understood that the tool 410 can be practiced with a single handrail or more than two handrails. Further, while the embodiment illustrated in FIG. 10 shows the handrails 450 extending substantially the length of the tool 410, it should be understood that the handrails 450 can extend to any desired distance less than the length of the tool 410.

In the illustrated embodiment, the handrails 450 are formed from a rigid material, such as the non-limiting examples of tubular aluminum or steel. Alternatively, the handrails 450 can be formed from other desired materials such as the non-limiting example of fiberglass. The handrails 450 can be connected to the rails 412*a* and 412*b* in any desired manner.

Figure 11B:
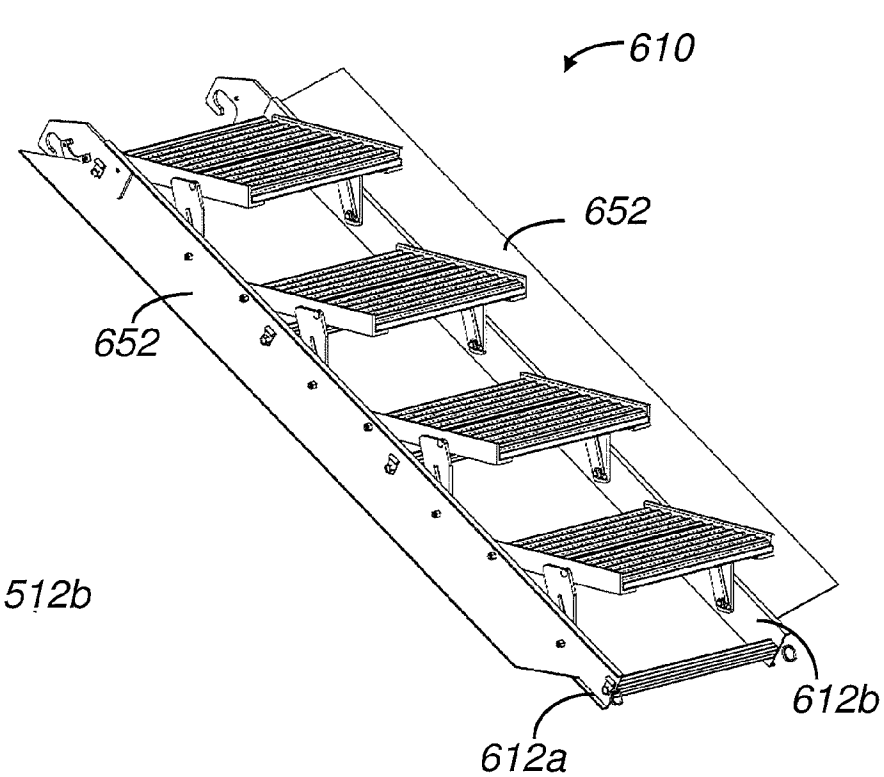
FIG. 11*b* is a perspective view of another embodiment of the elevator and escalator tool of FIG. 1 illustrating a plurality of second side guards attached to rails.
Figure 11A:
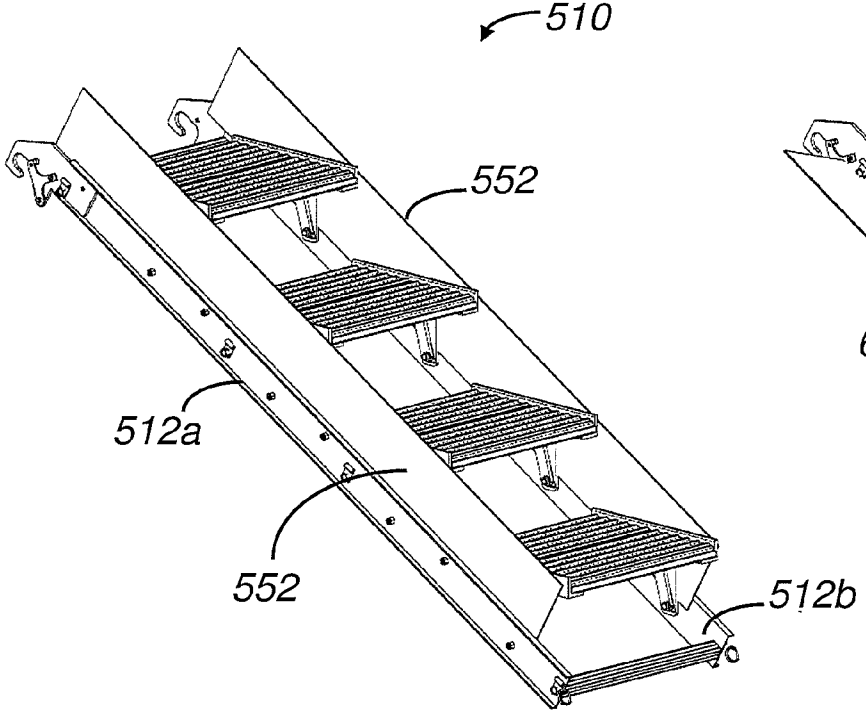
FIG. 11*a* is a perspective view of another embodiment of the elevator and escalator tool of FIG. 1 illustrating a plurality of first side guards attached to rails.

Referring now to FIG. 11*a*, another embodiment of a tool is shown generally at 510. In this embodiment, the tool 510 is the same as, or similar to, the tool 10 illustrated in FIG. 1 and discussed above with the exception that a plurality of first side guards 552 are attached to the rails 512*a* and 512*b*. The first side guards 552 are oriented in a substantially vertical arrangement and configured to provide a "toe guard" or "kick plate" for the safety of personnel positioned. While the embodiment illustrated in FIG. 11*a* shows a quantity of two first side guards 552, it should be understood that the tool 510 can be practiced with a lone first side guard 552 positioned on either of the rails 512*a* or 512*b*. Further, while the embodiment illustrated in FIG. 11*a* shows the first side guards 552 as extending substantially the length of the tool 510, it should be understood that the first side guards 552 can extend to any desired distance less than the length of the tool 510.

In the embodiment illustrated in FIG. 11*a*, the first side guards 552 are formed from a rigid material, such as the non-limiting examples of aluminum or steel. Alternatively, the first side guards 552 can be formed from other desired materials, such as the non-limiting example of reinforced polymeric materials. The first side guards 552 can be connected to the rails 512*a* and 512*b* in any desired manner.

Referring now to FIG. 11*b*, another embodiment of a tool is shown generally at 610. In this embodiment, the tool 610 is the same as, or similar to, the tool 510 illustrated in FIG. 11*a* and discussed above with the exception that second side guards 652 are oriented in a substantially horizontal arrangement relative to the rails 612*a* and 612*b*. In other embodiments, the second side guards 652 can be oriented in any desired orientation relative to the rails 612*a* and 612*b*.

While the embodiment illustrated in FIG. 11*b* shows a quantity of two second side guards 652, it should be understood that the tool 610 can be practiced with a lone second side guard 652 positioned on either of the rails 612*a* or 612*b*. Further, while the embodiment illustrated in FIG. 11*b* shows the second side guards 652 extending substantially the length of the tool 610, it should be understood that the second side guards 652 can extend to any desired distance less than the length of the tool 610.

Figure 12B:
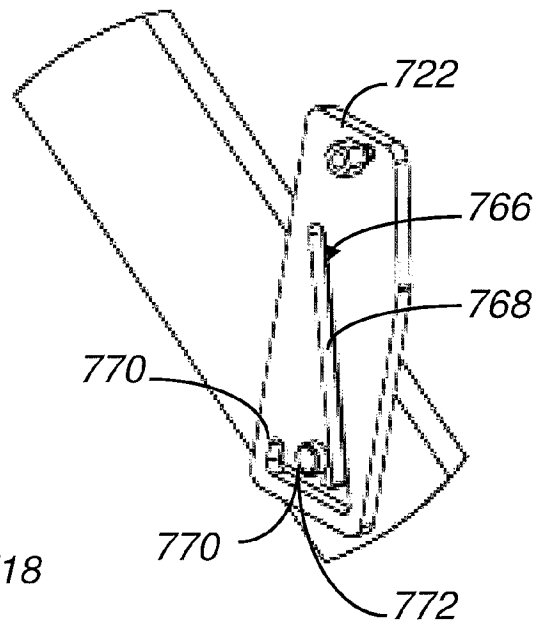
FIG. 12*b* is a perspective view of the brackets of FIG. 12*a* having a plurality of locking stations.
Figure 12A:
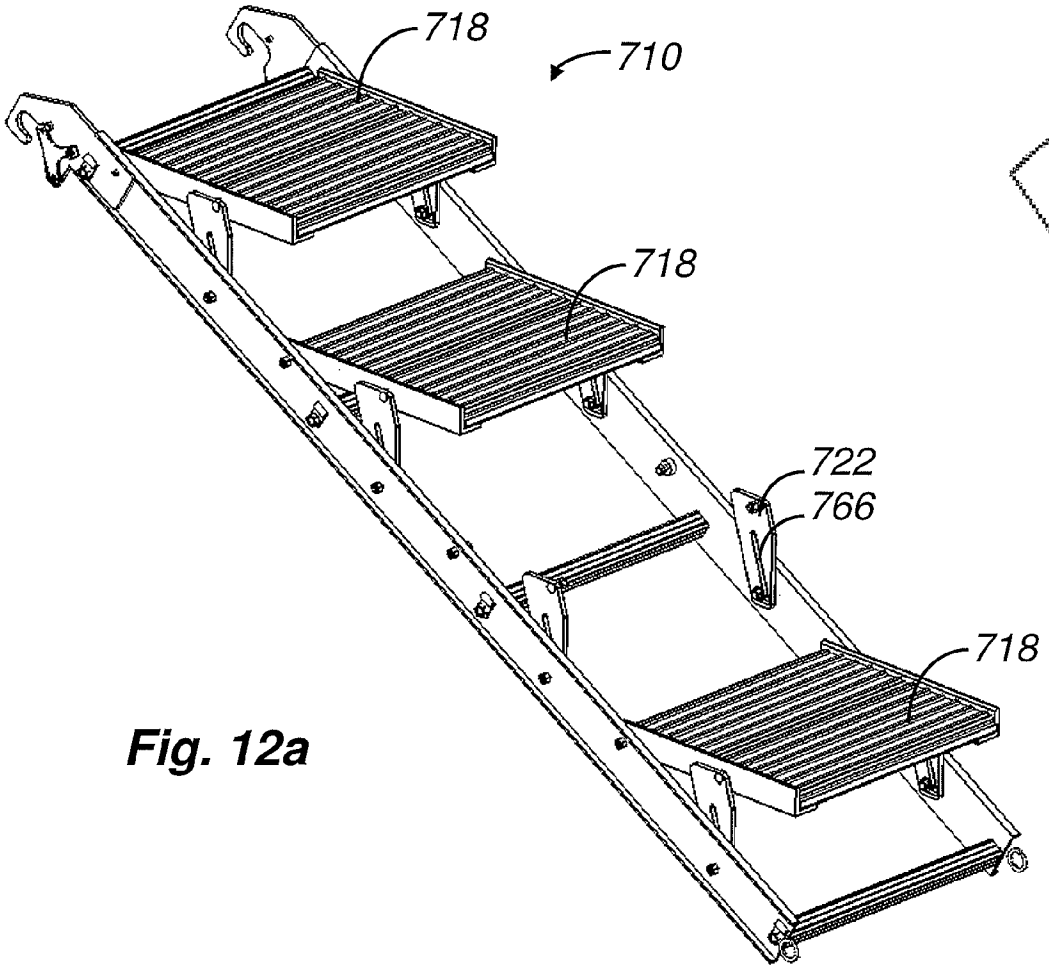
FIG. 12*a* is a perspective view of another embodiment of the elevator and escalator tool of FIG. 1 illustrating brackets having a plurality of locking stations.

Referring now to FIGS. 12*a* and 12*b*, another embodiment of a tool is shown generally at 710. In this embodiment, the tool 710 is the same as, or similar to, the tool 10 illustrated in FIG. 1 and discussed above with the exception that optionally the brackets 722 further include at least one locking configuration 766. The locking configuration 766 includes a track 768 having a plurality of locking stations 770 and a guide 772 along which the track 768 travels. In operation, rotation of the bracket 722 results in rotation of the track 768 about the guide 772 from one locking station 770 to another locking station 770. The locking stations 770 can be configured such that one locking station 770 can lock the treads 718 in a closed position and other locking stations 770 can lock the treads 718 in extended positions as shown in FIG. 12*a*. While the embodiment shown in FIGS. 12*a* and 12*b* illustrates the locking configuration 766 having a track 768 and a guide 770, it should be appreciated that in other embodiments, other structures, mechanisms and devices can be used to lock the treads 718 in various positions.

Figure 13:
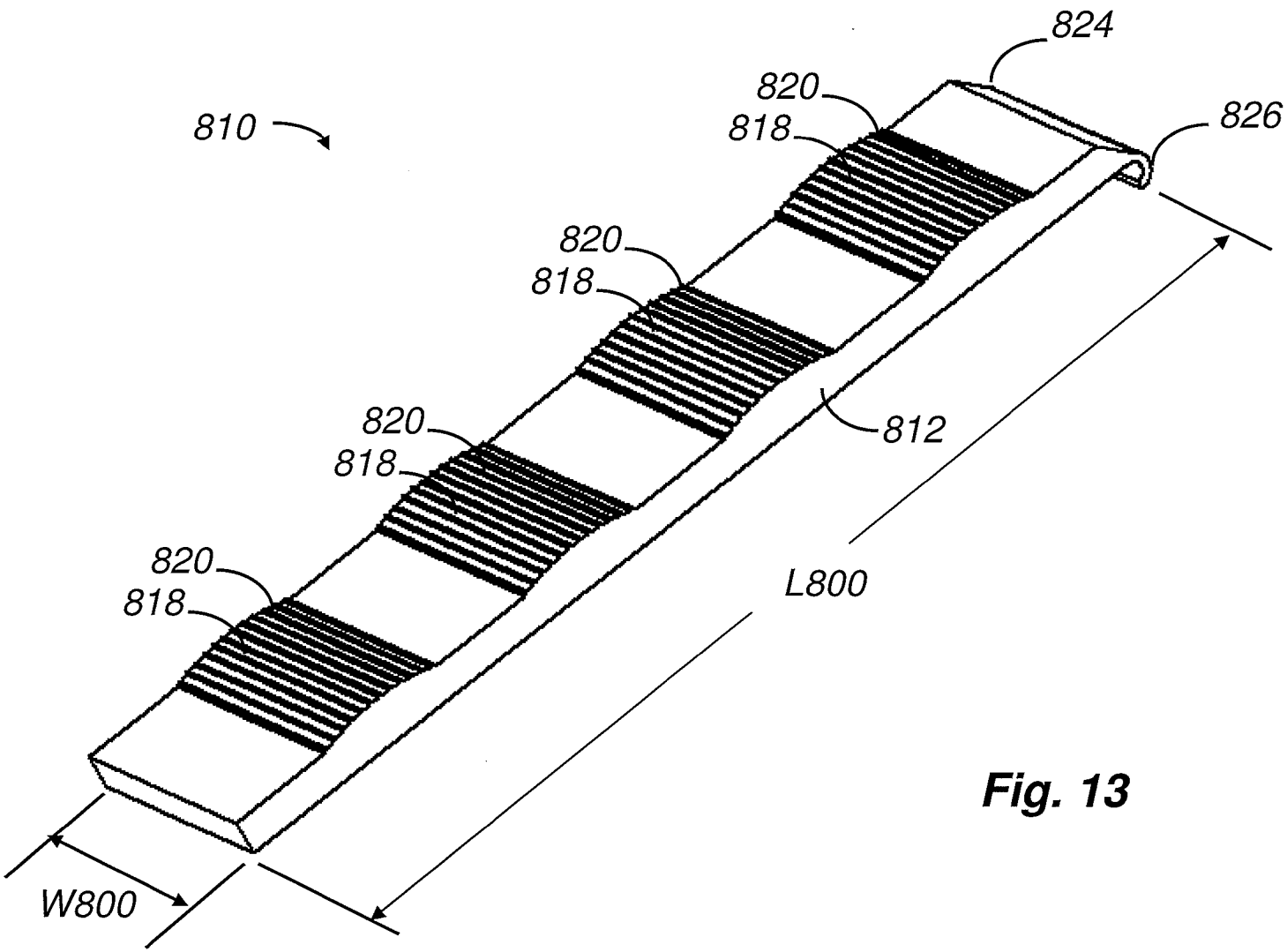
FIG. 13 is a perspective view of another embodiment of the elevator and escalator tool of FIG. 1 illustrating a unitary structure.

Referring now to FIG. 13, another embodiment of a tool is indicated generally at 810. In this embodiment, the tool 810 is optionally in the form of a single unitary structure rather than an assemblage of components. The term "unitary", as used herein, is defined to mean a single structure that forms the entire tool 810. In the illustrated embodiment, the tool 810 is formed from a reinforced polymeric material, such as the non-limiting examples of polystyrene, polyethylene, polypropylene, polyacrylonitrile or PVB. However, it should be appreciated that the tool 810 can be a unitary structure formed from other materials including bonded fiberglass. The tool 810 includes a base portion 812 and a plurality of tread portions 818 extending from the base portion 812.

Referring again to FIG. 13, the base portion 812 has a length L800 sufficient to support a desired quantity of tread portions 818. In the illustrated embodiment, the length L800 is the same as the length L of the rails 12*a* and 12*b* illustrated in FIG. 1 and described above. In other embodiments, the length L800 can be different from the length L, sufficient to support any desired number of tread portions 818. As shown in FIG. 13, the tool 810 has a width W800 in a range of from about 10.0 inches to about 30.0 inches. In other embodiments, the width W800 can be less than about 10.0 inches or more than about 30.0 inches.

The tread portions 818 are configured to provide a working surface upon which construction or maintenance personnel can stand, sit or kneel. The tread portions 818 are also configured as a surface upon which materials can be placed. Each tread portion 818 has an upper surface 820. In certain embodiments, the upper surface 820 is configured as a tread pattern having any desired tread design. In still other embodiments, the upper surface 820 can have other configurations, including the non-limiting examples of a smooth surface or an anti-slip surface.

Referring again to the embodiment illustrated in FIG. 13, the upper surfaces 820 of the tread portions 818 have an arcuate cross-sectional shape. In other embodiments, the upper surfaces 820 of the tread portions 818 can have any desire cross-sectional shape.

As shown in FIG. 13, the tool 810 also includes an integral extension member 824 extending from the base member 812. The extension member 824 includes a retention segment 826. In the illustrated embodiment, the retention segment 826 is the same as, or similar to the retention segment 26 illustrated in FIG. 1 and discussed above. In other embodiments, the retention segment 826 can be different from the retention segment 26.

In operation, the tool 810 can be used in the same manner as discussed above for the tool 10, such as to cooperate with step axles to bridge a gap formed by the removal of steps.

Figure 14:
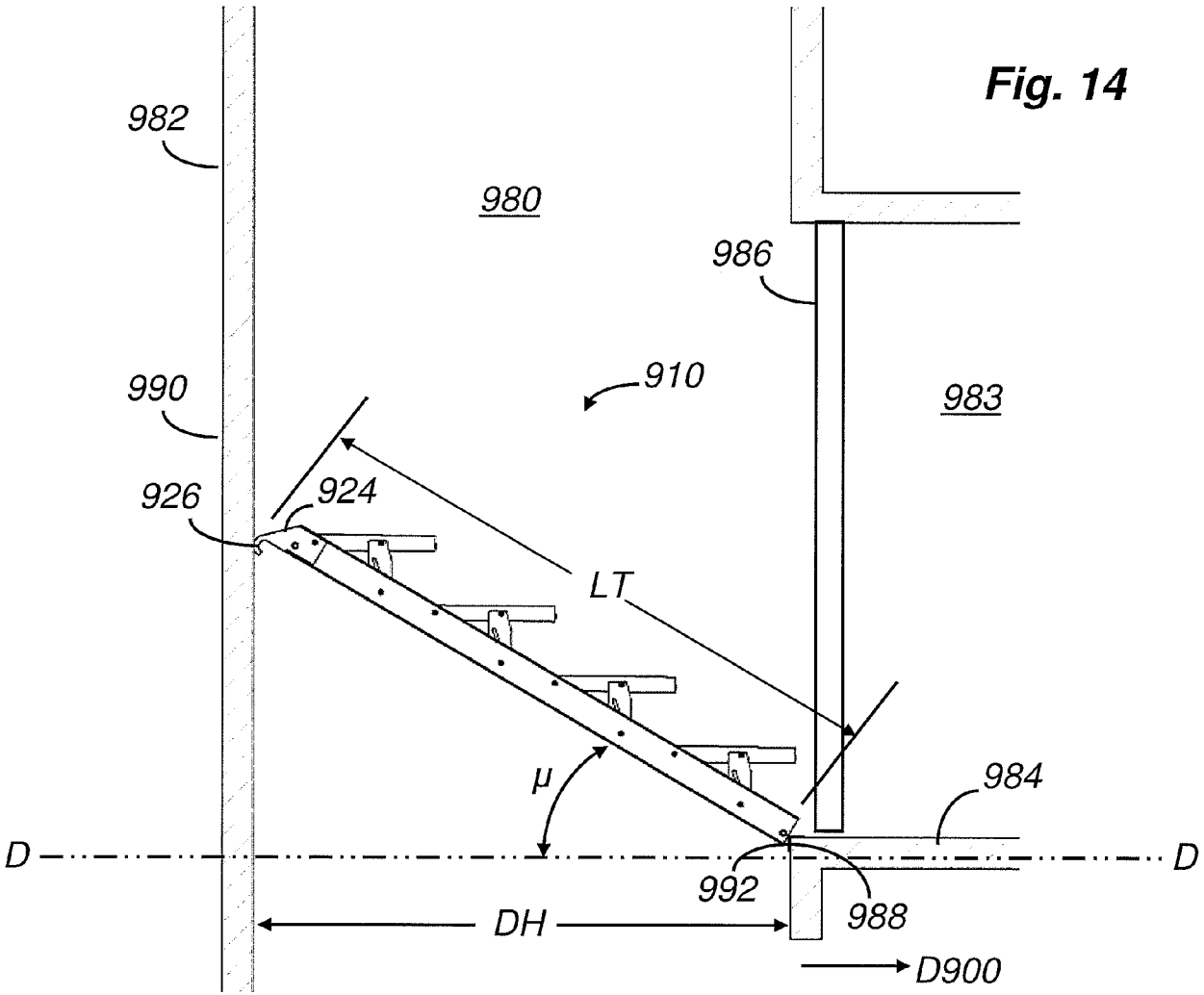
FIG. 14 is a side view, in elevation, of another application of the elevator and escalator tool of FIG. 1.

Referring now to FIG. 14, another application of a tool 910 is illustrated. In this embodiment, the tool 910 is used within an elevator hoistway 980 of a building 982 that is conventional in the art.

Referring again to FIG. 14, the building 982 includes a plurality of building floors 983 (for purposes of clarity only one building floor 983 is illustrated). The building 982 can have any number of building floors 983. Each building floor 983 includes a floor pad 984, an elevator entrance 986 and an entrance sill 988. The floor pad 984 is configured to provide a working surface for each building floor 983. In the illustrated embodiment, the floor pad 984 is constructed of reinforced concrete and has a thickness of approximately 10.0 inches. However, the floor pad 984 can be constructed of any appropriate material or materials, such as for example building steel, and can have a thickness of more or less than 10.0 inches.

The elevator entrance 986 separates the building floor 983 from the elevator hoistway 980 and provides an opening through which passengers can enter an elevator (not shown). The elevator entrance 986 can have any desired size, shape, thickness, and configuration.

The entrance sill 988 is a portion of the floor pad 984 and is positioned at the intersection of the floor pad 984 and the elevator hoistway 980. In the embodiment illustrated in FIG. 14, the upper section of the entrance sill 988 facing the elevator hoistway 980 forms a corner. However in other embodiments, the upper end of the entrance sill 988 facing the elevator hoistway 980 can form other desired shapes, such as for example a rounded edge.

Referring again to FIG. 14, the elevator hoistway 980 is bounded on one side by the elevator entrance 986 and on the other side by a hoistway wall 990. The hoistway wall 990 extends from the bottom of the hoistway 980 to the top of the hoistway 980. In the illustrated embodiment, the hoistway wall 990 is constructed of reinforced concrete and has a thickness of approximately 10.0 inches. However, the hoistway wall 990 can be constructed of any appropriate materials, such as for example concrete block, and can have a thickness of more or less than 10.0 inches. In the illustrated embodiment, the hoistway wall 990 has no openings along its height. However, the hoistway wall 990 can have any desired quantity of openings positioned at any desired location along its height.

The elevator hoistway 980 has a horizontal distance DH extending from the hoistway wall 990 to the elevator entrance 986. In the illustrated embodiment, the horizontal distance DH is approximately 8.0 feet. However, the horizontal distance DH can be more or less than approximately 8.0 feet.

Referring again to FIG. 14, it can be seen that the tool 910 (shown without the locking member for purposes of clarity), oriented in an inclined position, is configured to span the horizontal distance DH of the elevator hoistway 980, with one end of the tool 910 seated against the entrance sill 988 and the other end of the tool 910 seated against the hoistway wall 990. The tool 910 has a length LT that is longer than the horizontal distance DH of the elevator hoistway 980, thereby ensuring the tool 910 rests on an inclined orientation.

Referring again to FIG. 14, the tool 910 is shown with a first end seated against the entrance sill 988 and the other end seated against the hoistway wall 990. As discussed above, the tool 910 rests on an inclined orientation with respect to a substantially horizontal axis D-D. Axis D-D is defined as a line substantially perpendicular to the hoistway wall 990 and parallel to the floor pad 984. In the inclined position, the tool 910 forms an angle μ with axis D-D. Angle μ prevents the tool 910 from falling down the hoistway 980. In the illustrated embodiment, angle μ is approximately 30°. However, in other embodiments, angle μ can be can be in a range of from about 20° to about 70°.

Referring again to FIG. 14, one end of the tool 910 includes an optional sill attachment 992. The optional sill attachment 992 is configured to seat against the entrance sill 988 and allow the tool 910 to pivot. The sill attachment 992 is further configured to prevent movement of the tool 910 in a first direction D900, away from the hoistway wall 990, and also prevent the movement of the tool 910 in a second direction parallel to the entrance sill 988. In the illustrated embodiment, the sill attachment 992 has an "L" cross sectional shape configured to seat against the corner shape of the entrance sill 988. However, the sill attachment 992 can have other desired cross-sectional shapes sufficient to seat against the entrance sill 988.

Referring again to the embodiment illustrated in FIG. 14, the sill attachment 992 is made of steel. However in other embodiments, the sill attachment 992 can be made of other desired materials, such as for example aluminum, sufficient to seat against the entrance sill 988 and prevent the movement of the tool 910. In some embodiments, the inside surfaces of the sill attachment 992 can have a layer of slip resistant material or have a coating of slip resistant material.

Referring again to FIG. 14, the tool 910 includes an extension member 924 having a retention segment 926. In the illustrated embodiment, the extension member 924 and the retention segment 926 are the same as, or similar to, the extension member 24 and the retention member 26 illustrated in FIG. 1 and discussed above. The retention segment 926 is configured to seat against the hoistway wall 990 and provide supports for the tool 910 at the desired angle μ. In other embodiments, the extension member 924 can include other structures, mechanisms or devices, such as for example pivoting angles or spring-loaded members, sufficient to seat against the hoistway wall 990 and provide support for the tool 910 at the desired angle μ.

Figure 15:
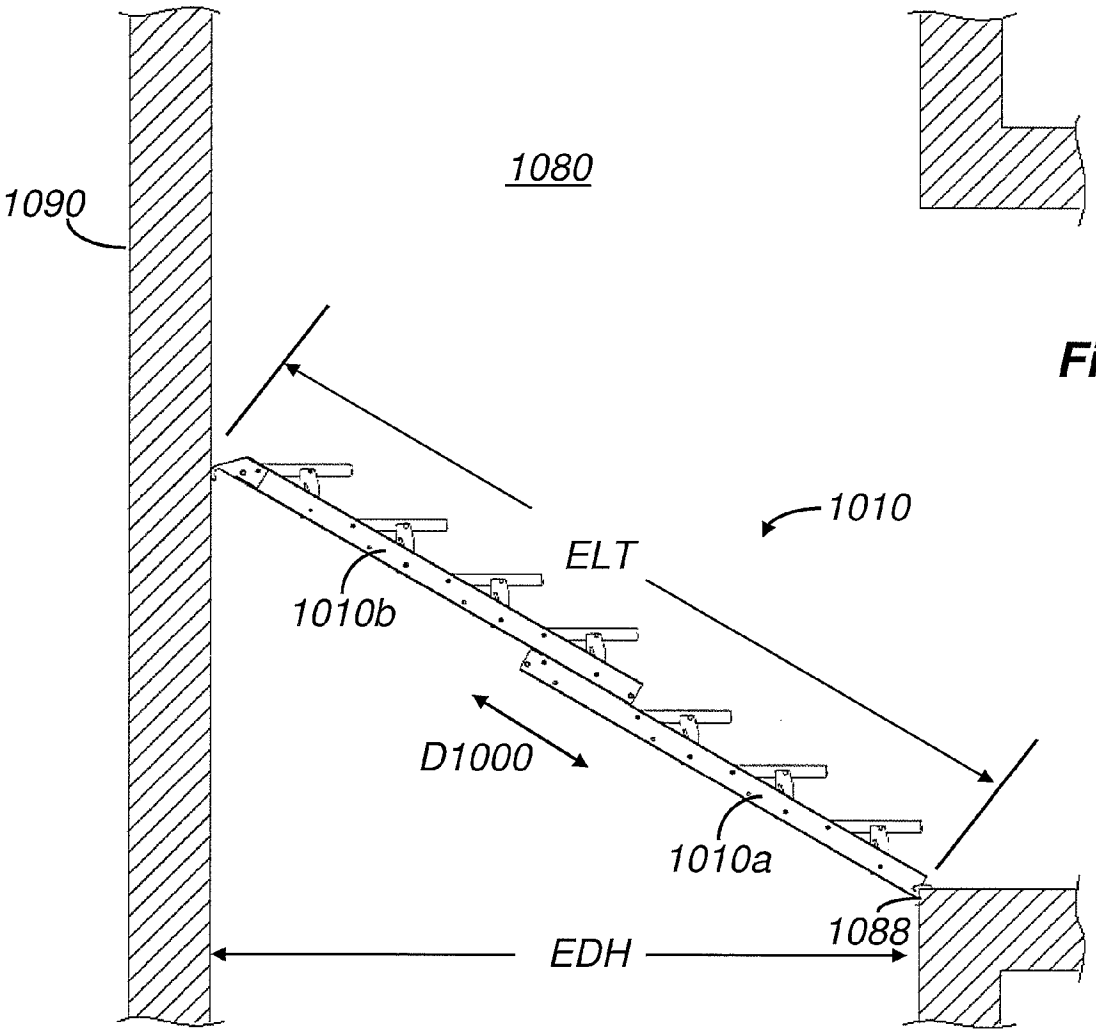
FIG. 15 is a side view, in elevation, of another application of the elevator and escalator tool of FIG. 1 illustrating multiple tools connected together.

Referring now to FIG. 15, another application of a tool is illustrated generally at 1010. The tool 1010 includes assemblies 1010*a* and 1010*b* formed together in a telescopic manner, such that the tool 1010 can be configured to span an extended horizontal distance EDH of an elevator hoistway 1080. In this embodiment, the assemblies 1010*a* and 1010*b* are slidably arranged relative to each other in the direction indicated by arrow D1000. In this manner the tool 1010 is extendable to different lengths ELT, such as in the form an extension ladder.

In the illustrated embodiment, the assemblies 1010*a* and 1010*b* can the same as, or similar to, the tool 10 illustrated in FIG. 1 and discussed above. Alternatively, the assemblies 1010*a* and 1010*b* can be different from the tool 10.

Referring again to FIG. 15, the tool 1010, oriented in an inclined position, is configured to span the extended horizontal distance EDH of the elevator hoistway 1080, with one end of the assembly 1010*a* seated against the entrance sill 1088 and one end of the assembly 1010*b* seated against the hoistway wall 1090. The length ELT of the tool 1010 is longer than the extended horizontal distance EDH of the elevator hoistway 1080, thereby ensuring the tool 1010 rests on an inclined orientation.

While the embodiment shown in FIG. 15 illustrates the assemblies 1010*a* and 1010*b* slidably joined together in an extension ladder arrangement, it should be appreciated that in other embodiments the assemblies 1010*a* and 1010*b* can be joined together in other arrangements, such as the non-limiting example of connecting plates or brackets that allow relative movement between the assemblies 1010*a* and 1010*b*. In still other embodiments, more than two assemblies can be joined together to form a tool. Joining multiple assemblies together as shown in FIG. 15 allows any horizontal distance EDH of the elevator hoistway 1080 to be spanned.

The principle and mode of operation of the elevator and escalator tool has been described in its preferred embodiments. However, it should be noted that the elevator and escalator tool may be practiced otherwise than as specifically illustrated and described without departing from its scope.

What is claimed is:

1. A tool for use in the construction and maintenance of elevators and escalators, the tool comprising:

two or more assemblies connected together in a slidable arrangement, each of the assemblies having: a plurality of rails connected together and arranged in a generally parallel orientation, a plurality of support members connected to the plurality of rails, a plurality of treads attached to the plurality of support members, the plurality of treads configured to provide a working surface upon which construction or maintenance personnel can stand, sit or kneel, the plurality of treads is further configured to provide a working surface upon which materials can be placed and an extension member connected to one end of each of the rails, each extension member including a locking member and a stop, each locking member including a first arm, a second arm extending from the first arm and a third arm extending from the second arm, and wherein in an open position, the third arm of the locking member is in contact with the stop and in a closed position, the second arm is in contact with the stop;

wherein the two or more assemblies are configured to bridge gaps formed within the elevators and escalators and bridge gaps formed in building spaces in and around the elevators and escalators.

2. The tool of claim 1, wherein the assemblies are arranged in a telescoping manner.

3. The tool of claim 1, wherein the support members and the treads are rotatable from a closed position to an extended position.

4. The tool of claim 3, wherein in the extended position, the treads are oriented in a substantially horizontal position.

5. The tool of claim 3, wherein in a closed position, the treads are substantially parallel with the rails.

6. The tool of claim 1, wherein the extension members have retention segments configured to seat against a hoistway wall.

7. The tool of claim 1, wherein the extension members have retention segments configured to engage an escalator step axle.

8. The tool of claim 1, wherein each of the locking members is rotatable between the open position and the closed position.

9. The tool of claim 1, wherein the locking members are actuated by release lines.

10. The tool of claim 1, wherein the support members and the treads are removable.

11. The tool of claim. 1, wherein the treads are formed by tread elements and wherein the tread elements have a major axis that is parallel to a longitudinal axis of the support members.

12. The tool of claim 1, wherein the treads are formed by tread elements and wherein the tread elements are rotatable such as to allow access to portions of the elevator or escalator.

13. The tool of claim 1, wherein a plurality of pan elements can be attached to the rails and wherein the pan elements are configured to catch construction materials falling through the tool.

14. The tool of claim 1, wherein a plurality of handrails are attached to the rails and wherein the handrails are configured for the safety of personnel positioned on the tool.

15. The tool of claim 1, wherein the support members are attached to rotatable brackets and wherein the brackets are configured for rotation from one locking station to another.

16. The tool of claim 1, wherein the tool is configured to span an elevator hoistway, thereby forming an angle in a range of from about 20° to about 70° with a substantially horizontal plane.

17. The tool of claim 1, wherein each of the treads has an upper surface, the upper surface having a tread pattern formed from parallel projections.

18. The tool of claim 1, wherein the support members are connected to the rails in part by brackets.

19. The tool of claim 2, wherein in an extended position, the treads form an angle relative to the rails, and wherein the angle is in a range of from about 20° to about 40°.

20. The tool of claim 1, wherein one end of the tool has a sill attachment configured to seat against an entrance sill.

* * * * *